US006058726A

United States Patent [19]

Noritake

[11] Patent Number: 6,058,726

[45] Date of Patent: May 9, 2000

[54] DAMPER

[75] Inventor: Seiichiro Noritake, Nagano, Japan

[73] Assignee: Sankyo Seiki Mfg. Co., Ltd., Nagano-ken, Japan

[21] Appl. No.: 08/867,155

[22] Filed: May 30, 1997

[30] Foreign Application Priority Data

May 30, 1996 [JP] Japan ..... 8-158990
May 30, 1996 [JP] Japan ..... 8-158991
May 30, 1996 [JP] Japan ..... 8-158992

[51] Int. Cl.[7] ..... F16K 11/052; F16K 11/22

[52] U.S. Cl. ..... 62/186; 137/595; 137/870

[58] Field of Search ..... 137/595, 597, 137/870; 62/186, 187; 251/251

[56] References Cited

U.S. PATENT DOCUMENTS 3,220,212 11/1965 Fordsmand ..... 62/186
3,248,893 5/1966 McLean ..... 62/186
3,847,210 11/1974 Wells ..... 137/595
4,870,990 10/1989 Bierling ..... 137/595
5,048,577 9/1991 Kuusisto ..... 137/595
5,398,910 3/1995 Kitazawa ..... 251/129.11

*Primary Examiner*—Stephen M. Hepperle
*Attorney, Agent, or Firm*—McAulay Nissen Goldberg Kiel & Hand, LLP

[57] ABSTRACT

A damper comprises two cold air inlets through which a fluid flows, two gate plates which open and close the two cold air inlets and a drive unit for driving the two gate plates. The drive unit is installed between the two cold air inlets to open and close the gate plates. The drive unit operates to control the fluid flow. In a particular form, the damper is installed in a refrigerator for opening and closing two cold air inlets of the refrigerator.

12 Claims, 17 Drawing Sheets

DAMPER

BACKGROUND OF THE INVENTION a) Field of the Invention

The present invention relates to a damper which actuates gate plates such as baffles for cold air inlets using a motor as a driving source. It specifically relates to a damper suited to control cold air distribution in a refrigerator.

b) Description of the Related Art

A conventional damper is disclosed in, for example, Japanese patent laid open H6-109354 or U.S. Pat. No. 5,398,910. (See FIG. 24.)

The damper 70 of the structure is used in a refrigerator 80 as illustrated in FIG. 25. The refrigerator 80 is divided into a freezer 81 and a refrigeration chamber 82 and an evaporator 84 is arranged at the bottom of the freezer 81. A fan motor 85 is arranged behind the evaporator 84 to circulate cold air obtained at the evaporator 84 through the freezer 81 and the refrigeration chamber 82. A partition 86 is provided between the evaporator 84 and the refrigeration chamber 82, which prevents cold air in the evaporator 84 from flowing directly into the refrigerating chamber 82. Cold air passage 87 is provided between the back of the partition 86 and the inner wall of the refrigerator 80.

In the motor damper 70, a baffle 72 and a driving mechanism 73 including a synchronous motor etc. are arranged putting the pivot, the rotation center, for the baffle 72 therebetween. The drive mechanism 73 transforms the rotational torque of the synchronous motor and puts out a force in the thrust direction, using a rack and pinion mechanism, to rotate the baffle 72 around the pivot 71 to open/close the baffle 72. To control temperature in the refrigerator, cold air is shut completely when the baffle 72 is closed, it flows into each of the chambers when the baffle 72 is opened.

In the aforementioned motor damper 70, the torque in the rotational direction is transmitted as torque in the thrust direction. When considering the manufacturing accuracy each component must have, the engagement of the baffle 72 or the members in the driving mechanism 73 need to have some tolerance. On the other hand, to control temperatures accurately, cold air must be shut completely when the baffle 72 is closed.

Therefore, in the motor damper 70, in order to better seal the space between the baffle 72 and the frame 74 to close the cold air inlet 76 with the baffle 72 completely, a plate spring (not illustrated) is provided to press the baffle 72 in the same direction. In addition, the contact surface of the baffle 72 and the frame 74 is sealed with a soft tape 75 to hold the frame 74.

In the structure, the plate spring pressure is strong enough to shut cold air completely; however, the pressure from the plate spring varies depending on the open-close position of the baffle 72; it is not preferable to operate the drive mechanism 73 such as a synchronous motor against this pressure.

In addition, because the motor damper uses the rack and pinion structure, the baffle 72 does not open to the position parallel to the cold air flow; it opens to the lower position as shown in FIG. 25. Therefore, even if the baffle 72 is open, it impedes cold air flow; this is unfavorable for diffusing cold air rapidly. Moreover, the angle by which the baffle 72 opens tends to become even smaller due to warping of the plate spring.

Furthermore, the rack and pinion mechanism requires wider than normal width N in the driving mechanism 73, occupying a large dead space therein.

Recently, popular refrigerators have separate chambers such as a refrigeration chamber, a freezer, a vegetable crisp in which temperatures are controlled for each of the chambers separately; or they have a large chamber in which temperatures are controlled for each of the upper and lower sections separately. In these types of refrigerators, cold air passages 87 are provided exclusively for each of the chambers or sections to control the amount of cold air which flows into each of the chambers.

To accomplish the task, some refrigerators use a plurality of apparatus such as the motor damper 70 as shown in FIG. 24; some refrigerators use a double damper 77 having two hollow sections shown in FIG. 26.

In the aforementioned double damper 77, two hollow sections 76*a*, 76*b* are formed on the frame 74; the drive mechanism 73 including a motor etc. is arranged at the back bottom. Baffles 72*a*, 72*b*, which are the same as those used in the motor damper 70, are arranged for each of the inlets; each of the baffles 72*a*, 72*b* controls cold air for each of the cold air passages 87, 87 independently.

These baffles 72*a*, 72*b* are driven by one synchronous motor (not illustrated) in the drive mechanism 73 and operate in the following four modes:

both baffles 72*a*, 72*b* are open;

both baffles 72*a*, 72*b* are closed;

the baffle 72*a* is open and 72*b* is closed; or the baffle 72*a* is closed and 72*b* is open.

The double damper 77 obtains output from the synchronous motor via a rack and pinion to move the baffles 72*a*, 72*b* arranged above the driving mechanism 73 independently. This increases the size of the driving mechanism 73 including the synchronous motor, rack and pinion mechanism, etc. Particularly in this structure, the rack is abutted to the pivotal side of the center portion of the baffle 72*a*, 72*b*, the distance R between the racks becomes large; this increases the size of the driving mechanism 73.

On the other hand in order to decrease the size of the driving mechanism, the distance between both of the hollow sections 76*a*, 76*b* must be small. A small distance P between both of the hollow sections 76*a*, 76*b* provides insufficient heat insulation for the space between the cold air passages 87 which communicate with two cold air inlets 76, 76: change in temperature in one of the cold air passage 87 affects the temperature of the other cold air passage 87. This makes it difficult to accurately control temperature for each of the chambers.

Some popular dampers uses a motor such as a DC motor or stepping motor, not a synchronous motor, as a driving source. Many of these motors do not use a position sensor which increases cost but control parameters such as the active time or the number of pulses for opening and closing the baffle. However, in these types of dampers, the baffle may stop operating for a moment if the stepping motor fails to synchronize or if the baffle is frozen; the baffles may not be able to operate accurately. They may, for example, leak cold air because the baffle is not closed perfectly.

OBJECT AND SUMMARY OF THE INVENTION

The present invention intends to provide a damper which resolves the above problems. In other words, it intends to provide a damper for a compact highly efficient refrigerator having a plurality of baffles and accurately controls temperatures for a plurality of chambers or sections independently.

In accordance with the invention, a damper comprises two cold air inlets through which a fluid flows, two gate plates which open and close the two cold air inlets and a drive unit for driving the two gate plates. The drive unit is installed between the two cold air inlets to open and close the gate plates. The drive unit operates to control the fluid flow. In a particular form, the damper is installed in a refrigerator for opening and closing two cold air inlets of the refrigerator.

BRIEF DESCRIPTION OF DRAWINGS

In the drawings:

FIG. 15(A) is the baffle A side; FIG. 15(B) is the baffle B side;

FIG. 16(A) is the baffle A side; FIG. 16(B) is the baffle B side;

FIG. 17(A) is the baffle A side; FIG. 17(B) is the baffle B side;

FIG. 18(A) is the baffle A side; FIG. 18(B) is the baffle B side;

FIG. 19(A) is the baffle A side; FIG. 19(B) is the baffle B side;

FIG. 21(A) is a cross section showing a baffle in the front and a cold air passage; FIG. 21(B) is a cross section showing a baffle in the back and a cold air passage;

FIG. 23(A) shows the cam unit; FIG. 23(B) shows a front view of the entire apparatus;

DESCRIPTION OF THE PREFERRED EMBODIMENTS

Figure 1A:
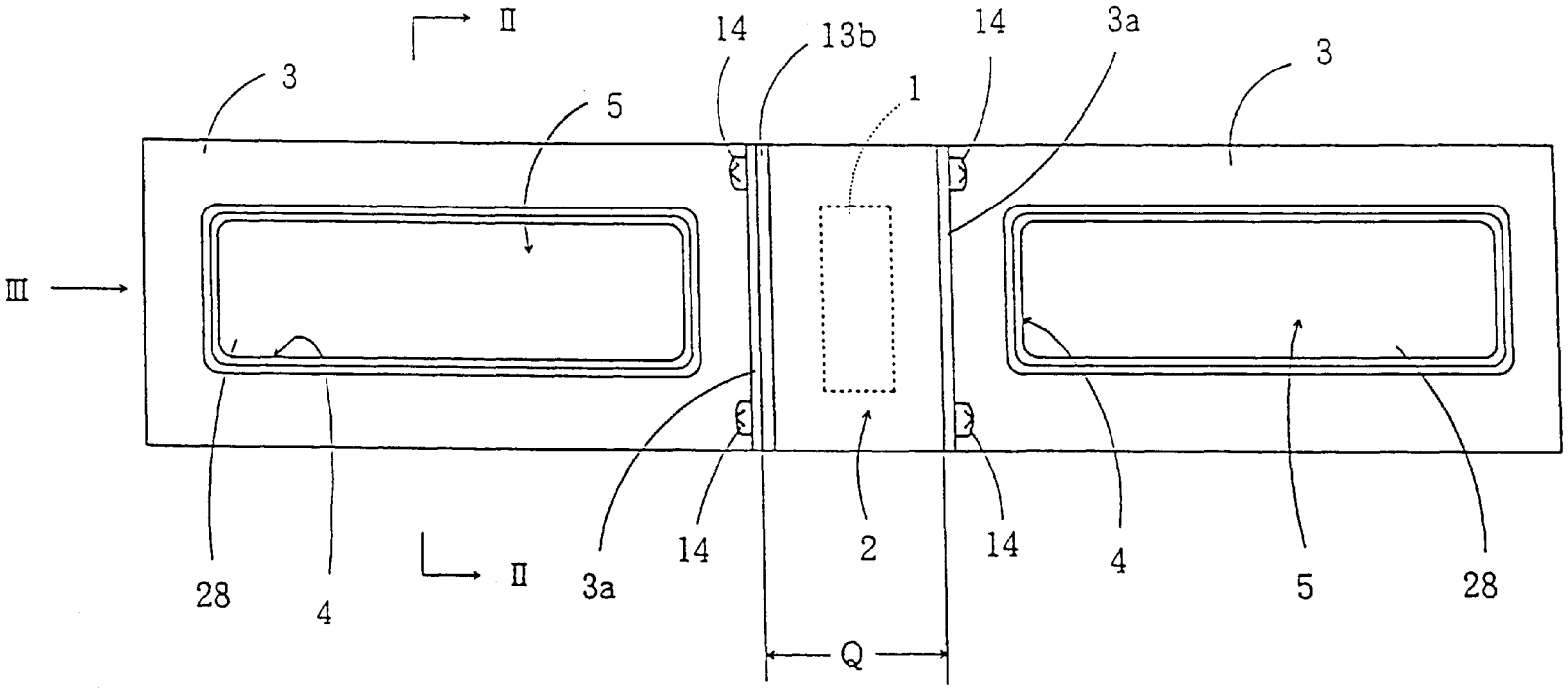
FIG. 1 is a plan view of the double damper of an embodiment of the present invention.

Embodiments of a damper of the present invention are described by referring to FIGS. 1 through 23. Note that the damper of this embodiment is the motor damper used in a refrigerator.

A double damper comprises:

a drive unit 2 having a stepping motor 1 arranged in the center;

two cylindrical frames 3,3 arranged at both ends of the drive unit 2 with open ends;

two cold air inlets 4, 4, formed on the frames 3, 3; and baffles 5, 5, which open/close for the cold air inlets 4, 4.

Note that the driving source is the stepping motor; the gate plates are the baffles 5, 5.

Figure 7:
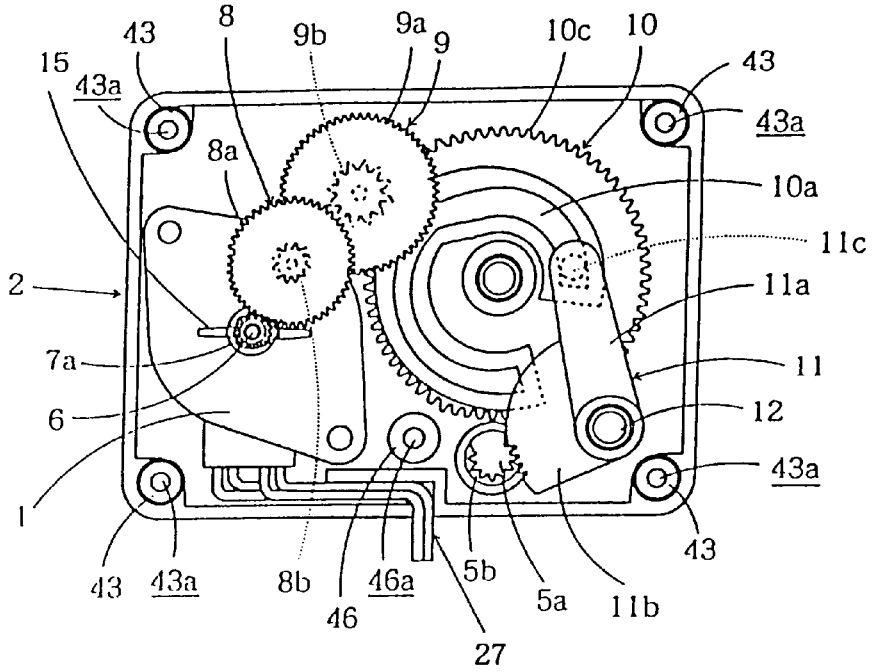
FIG. 7 is a diagram in which the base plate is removed from the drive unit of the double damper shown in FIG. 1.
Figure 8:
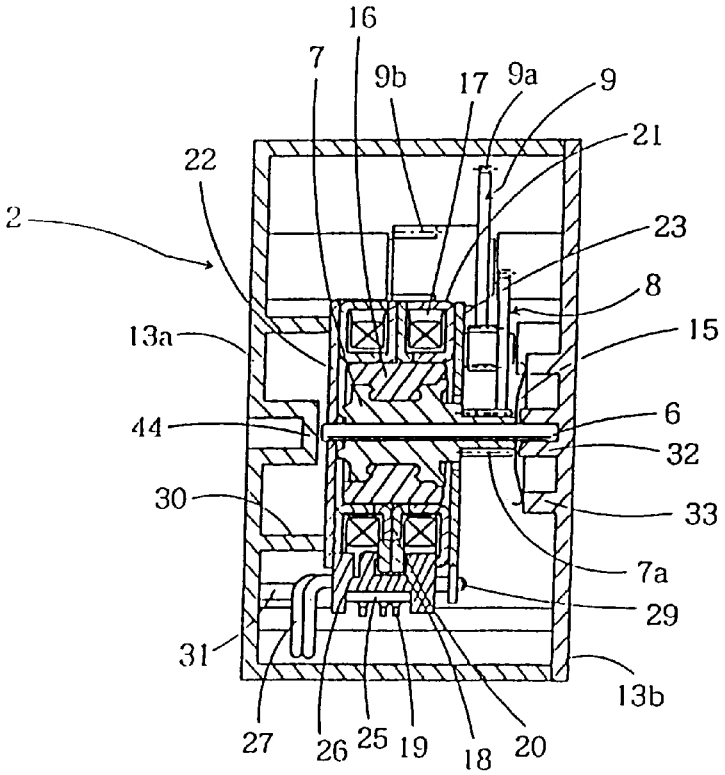
FIG. 8 is a cross section of a stepping motor section in the drive unit of the double damper shown in FIG. 1.

The stepping motor 1 comprises, as shown in FIGS. 7 and 8, a fixed shaft 6; a rotor 7 having a pinion 7*a* is rotatably engaged with the fixed shaft 6. Also, the pinion 7*a* is meshed with the gear section 8*a* of the first gear 8; the pinion section 8*b* of the first gear 8 is meshed with the gear section 9*a* of the second gear 9. The pinion section 9*b* of the second gear 9 is meshed with the cam gear 10*c* of the cam 10. The rotational force of a motor is reduced by the aforementioned gear train as described above.

Figure 10:
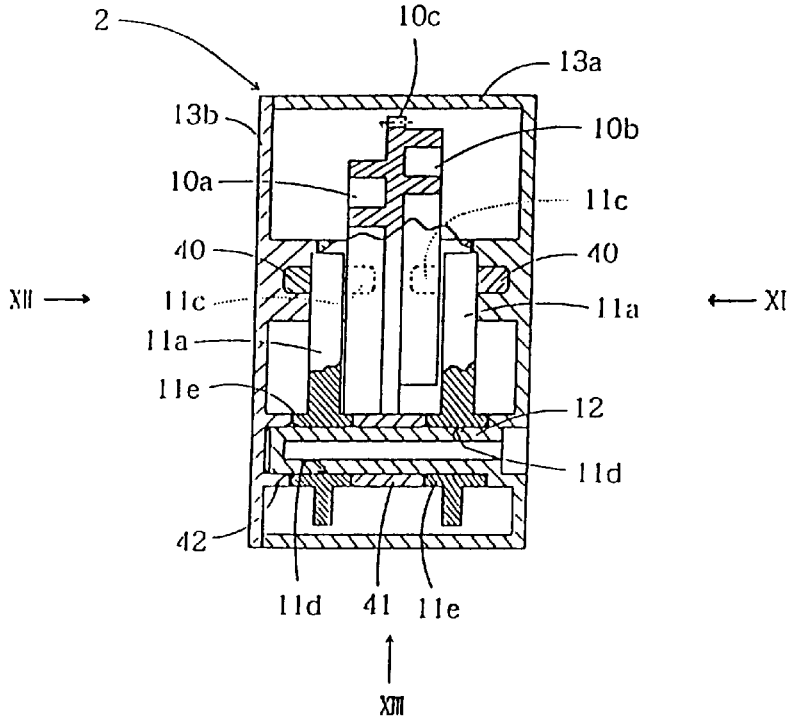
FIG. 10 is a partial cross-section of the cam in the drive unit and the arm unit of the double damper shown in FIG. 1.
Figure 11:
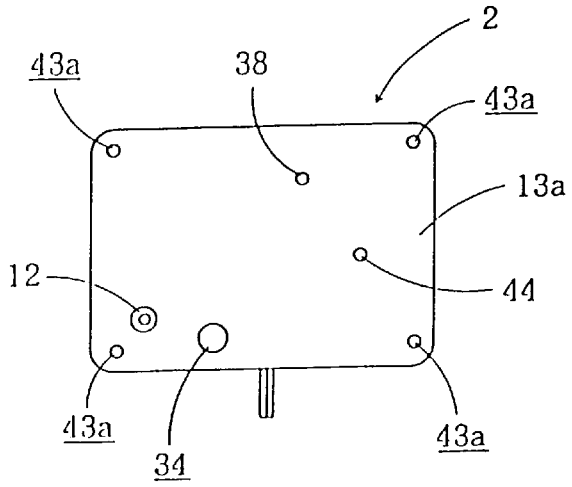
FIG. 11 is a side view of FIG. 10 viewed from the direction of the arrow XI.
Figure 12:
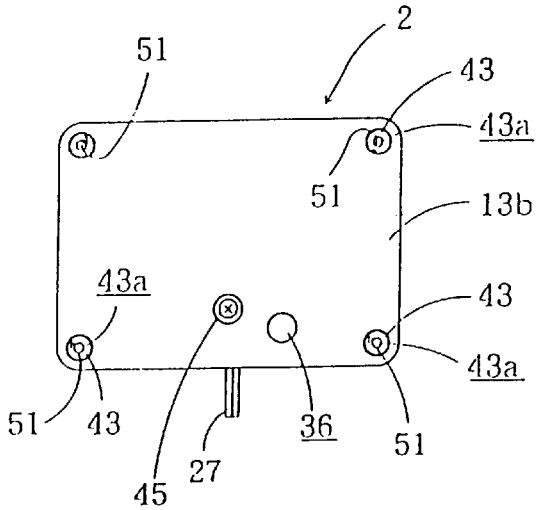
FIG. 12 is a side view of FIG. 10 viewed from the direction of the arrow XII.
Figure 13:
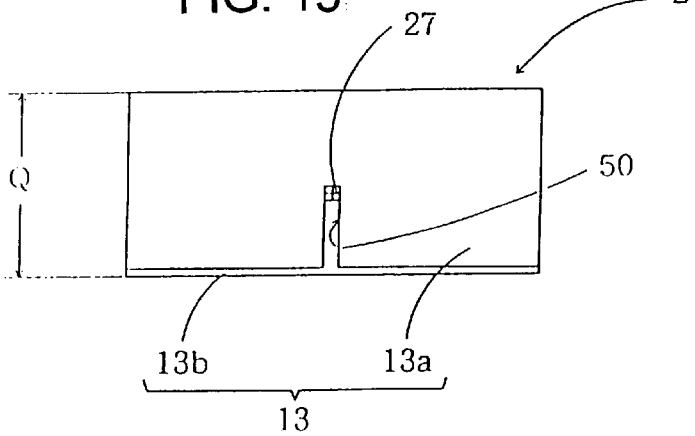
FIG. 13 is a side view of FIG. 10 viewed from the direction of the arrow XIII.

On both sides of the cam 10, U-shaped cam grooves 10*a*, 10*b*, which works as guide units, as shown in FIG. 10, are formed; arms 11, 11 are engaged with the cam grooves 10*a*, 10*b*. Each of the arms 11 comprises, around the pivot 12:

an arm section 11*a* projecting to one side;

a fan-like gear section 11*b* which provides an engagement section projected to the other side at a 90 degrees position from the arm section 11*a*; and a projected pin attached on top of the arm section 11*a*.

The pin 11*c* is fitted into the cam grooves 10*a*, 10*b* which regulate the pin location to guide the pins inside the cam grooves 10*a*, 10*b*.

The fan-like gear section 11*b* is meshed with the drive shaft 5*a* formed on the baffle 5 to transmit the rotation of the arm 11 to the baffle 5. To describe the movement in detail, the gear 5*a* formed on the drive shaft 5*a* is engaged with the fan-like gear 11*b* to transmit the rotation of the arm 11 to the baffle 5.

Note that the distance between the pivot 12 and the top of the fan-like gear 11*b* is made smaller than that between the pivot 12 and the pin 11*c*; therefore, the fan-like gear 11*b* moves with a smaller radius than the arm section 11*a*. Under the principle of leverage, the force which moves the gear 5*b* is large even if the force which moves the arm 11 is small.

On the other hand, the diameter of the fan-like gear 11*b* is larger than that of the gear 5*b* formed on the drive shaft 5*a* and is given a larger number of teeth such that increased rotation is transmitted from the gear train comprising a fan-like gear section 11*b* to the gear 5*b*.

The drive mechanism for rotating the baffle 5 is covered by a unit case unit 13. The case unit 13 is constructed with a case 13*a* and a base plate 13*b;* cylindrical frames 3, 3 are attached by a plurality of screws 14 on sides of the case unit 13. Both ends of the drive shaft 5*a* of the baffle 5 are supported by the side walls 3*a,* 3*a* on both sides of the frame 3. Also, a transmission means is constructed with a pinion 7*a;* a first gear 8;

a second gear 9;

a cam 10;

an arm 11; and a gear 5*b*.

The moving range for the fan-like gear 11*b* of this embodiment is set to about 45 degrees.

FIG. 8 is the detailed configuration of a stepping motor 1. That is, the rotor 7 comprises:

a pinion 7*a;* a magnet 16;

a magnet wire 17 which is arranged opposite the magnet 16 and surrounds the rotor section of the motor;

a bobbin 18 in which the projected pin 19 is attached;

two cores 20; and a motor stator section made of two stator cases 21.

In addition, side plates 22 and mounting plate 23 are attached to surround the stator cases 21, 21.

The projected pin 19 is electrically connected with a print circuit formed on a substrate 25; the substrate 25 is attached to a bracket 26. On the other hand, the substrate 25 is connected to a lead wire 27 which supplies power to the stepping motor 1 externally. The lead wire 27 goes out from the bottom of the cutaway 50 (See FIG. 13) of the case 13*a,* that is, the central position of the thickness Q of the drive section 2.

The side walls 22 are loaded on the circular support section 30 projected inside the unit case 13*a;* the stepping motor is mounted onto the unit case 13*a* by fixing the mounting plate 23 with screws 29 also attached to the support 31. The fixed shaft 6 is fitted into the fitting supporter 32 of the base plate 13*b*. In addition, a plate spring 15 is sandwiched between the circular spring supporter 33 and a pinion 7*a* to transmit the force of the rotor 7 to the unit case 13*a* side. In this way, the force of the rotor 7 is transmitted to one side via the spring 15; this prevents vibration.

Each of the cylindrical frames 3 in this embodiment has a thin square shape. A cold air inlet 4 is formed inside the frame 3 and the drive shaft 5*a* of the baffle 5 is stored in the frame 3. Side walls 3*a,* 3*a* are formed to support the drive shaft 5*a* at both sides of the frame 3 and a notch like engagement hole 3*b* is formed at the gear 5*a* side to support the drive shaft 5*a*.

On the other hand, the other end of the drive shaft 5*a* is fitted into the fitting hole 3*c* formed on the side wall 3*a* to rotatably support the drive shaft 5*a*. With this configuration, the baffle 5 can be rotated around the drive shaft 5*a* to open/close in the arrow direction shown in FIG. 2.

Figure 2:
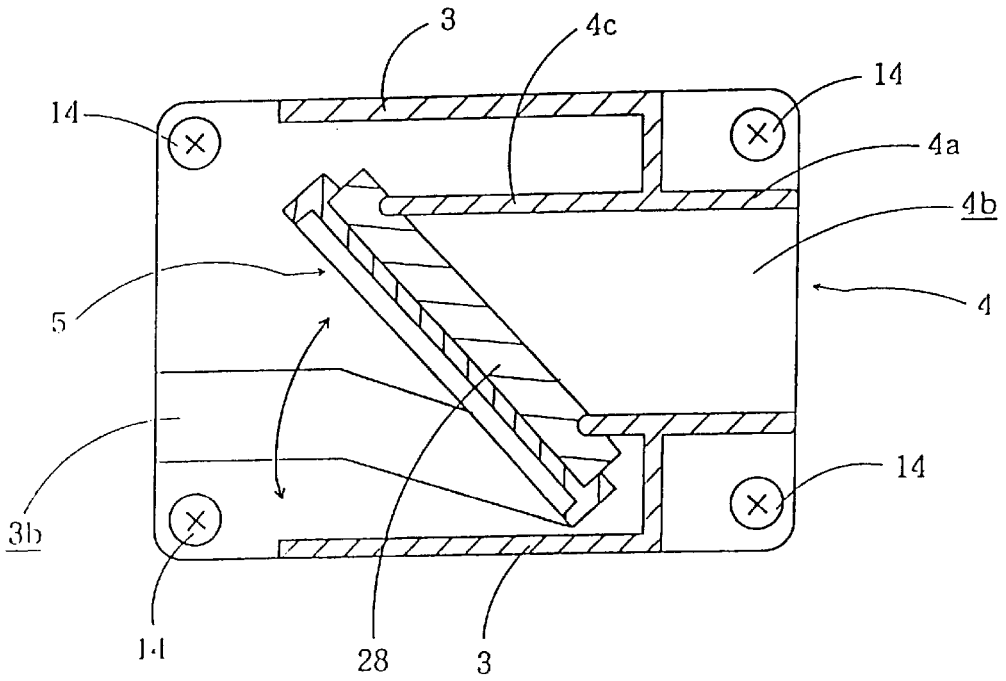
FIG. 2 is a II—II cross-section of FIG. 1.
Figure 3:
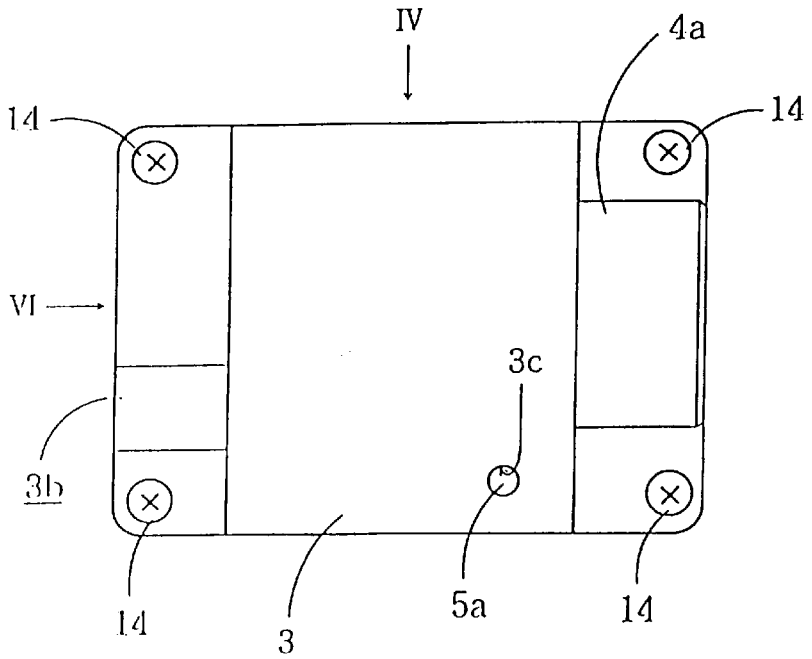
FIG. 3 is a side view of FIG. 1 viewed from the direction of the arrow III.
Figure 4:
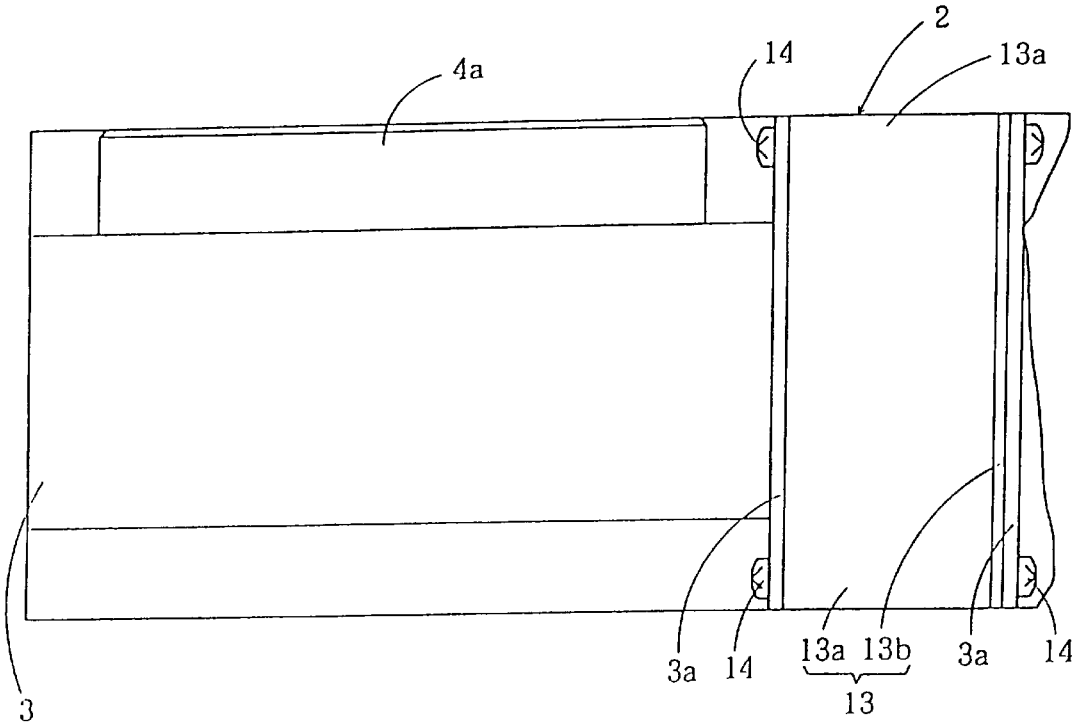
FIG. 4 is a plan view of the left side of FIG. 3 viewed from the direction of the arrow IV.
Figure 5:
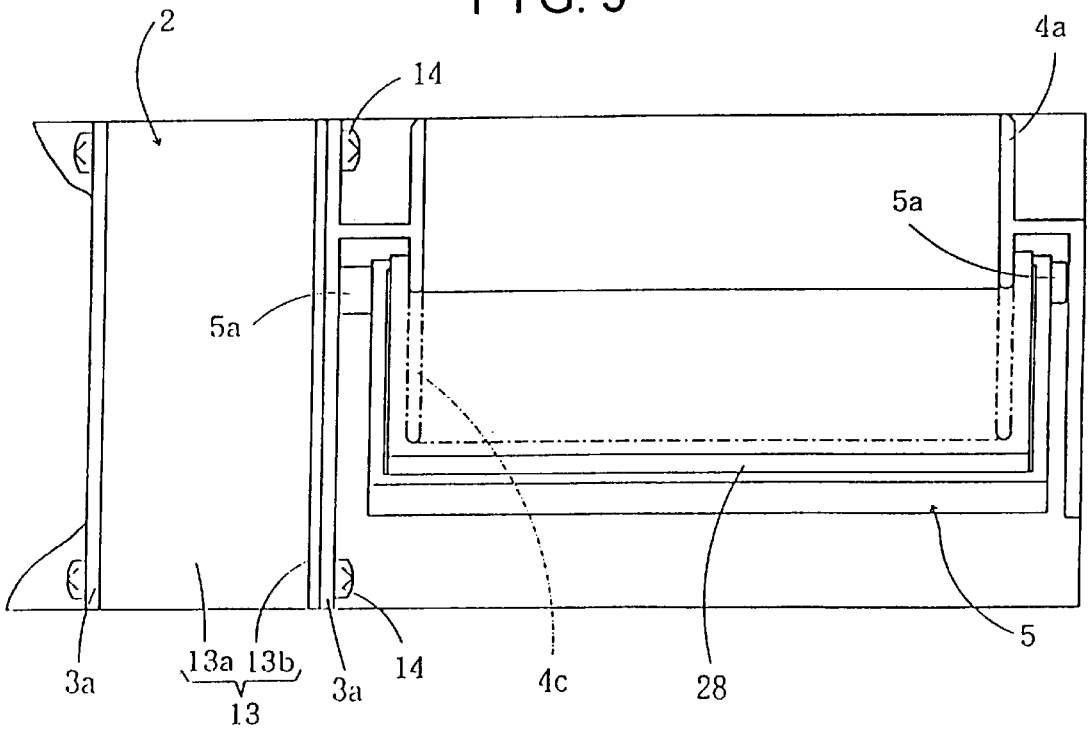
FIG. 5 is plan view without the upper frame on the right side of the plan view of FIG. 4.

The frame 3 and inlet forming section 4*a* projected in parallel with the frame 3 surround the hollow section 4*b* to form a cold air inlet 4, as shown in FIG. 2. The inlet forming unit 4*a* has a projected section 4*c* which contacts the baffle to form a contact surface. In this embodiment, the length of the projected section 4*c* is made different as shown in FIG. 2 such that the baffle 5 contacts it at a slanted position. Note that the cold air inlet 4 is formed integral with the frame 3, however, it can be formed as a different member.

A soft tape 28 is attached to the cold air inlet 4 side of the baffle 5 to construct a part of the baffle 5. Note that a foamed polyurethane is used for the soft tape 28 to obtain a large compression, however, other resilient members such as a foamed polyethylene or rubber member may be used. Note that in the back of the baffle 5, ribs may be formed to reinforce the strength of the baffle 5.

Figure 9:
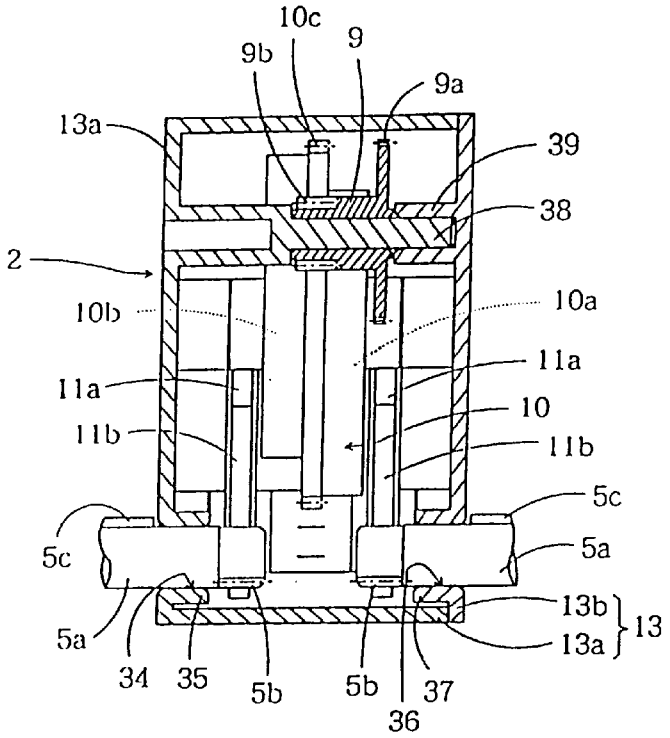
FIG. 9 is a cross-section of the drive shaft and the second gear section of the double damper shown in FIG. 1.

As shown in FIG. 9, on the drive shaft 5*a* of the baffle 5, besides the gear 5*b,* a touch projection 5*c* is formed in the radius direction; when the gear 5*b* is put into a fitting hole 34 of the case 13*a,* the projection 5*c* touches the case 13*a,* thus the drive shaft 5*a* is aligned. The drive shaft 5*a* is rotatably supported by a bearing unit 35 surrounding a fitting hole 34. On the other hand, the fitting hole 34 is also formed on the base plate 13*b* such that the other gear 5*b* can be put through. In the same manner, the drive shaft 5*a* is rotatably supported by the bearing unit 37 surrounding the fitting hole 36.

The first gear 8 shown in FIG. 8 is made of resin; one end is fixed onto the mounting plate 23; the other end is rotatably supported by the shaft fixed onto the base plate 13*b*. The second gear 9 is rotatably supported by the support shaft 38 formed integral with the case 13*a* as shown in FIG. 9. Note that the tip of the support shaft 38 is fitted into the cylindrical support section 39 formed on the base plate 13*b*.

Figure 15A:
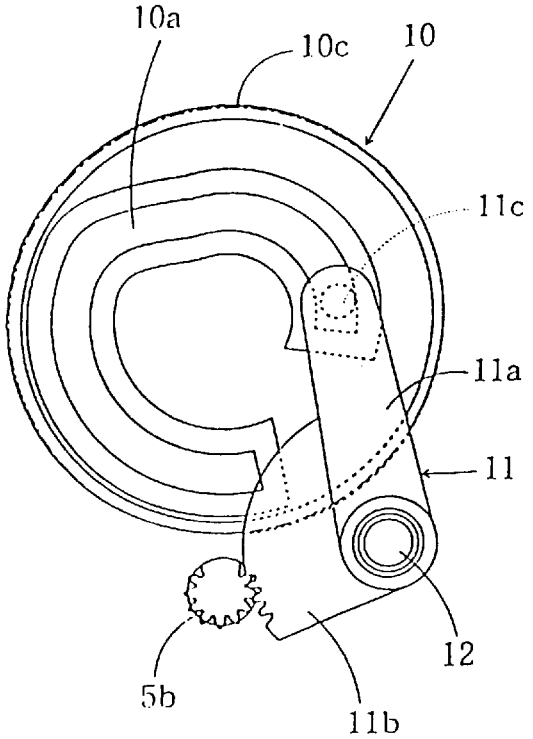
FIGS. 15(A) and 15(B) show the relationship between the cam and arm when the cam of the damper is at 0 degrees of the groove cam angle.
Figure 15B:
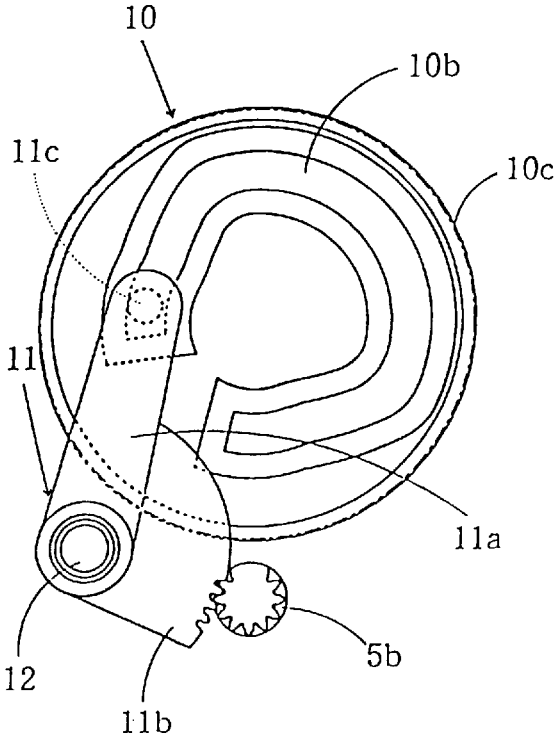
Figure 16A:
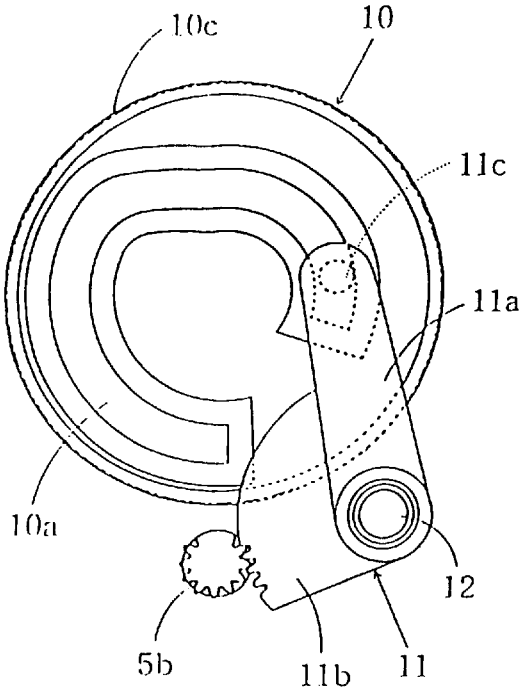
FIGS. 16(A) and 16(B) shows the relationship between the cam and arm when the cam of the damper is at 10 degrees of the groove cam angle.
Figure 16B:
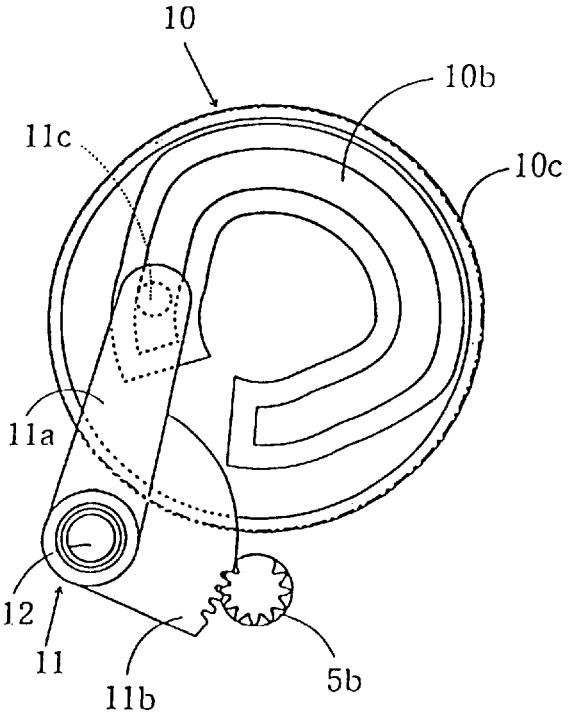

The cam 10 is made of resin and formed as a disk. As shown in FIG. 10, the supporters 40, 40 are fixed onto the case 13*a* and the base plate 13*b;* the supporter 40 is rotatably supported by fitting it into the concavity in the center of the cam. The cam grooves 10*a,* 10*b* formed on its both surfaces are, as shown in FIG. 15, formed in circle. The baffles 5, 5 move from the close-close position to close-open position, then the open-open position to the finally open-close position as the cam 10 rotates.

Figure 14:
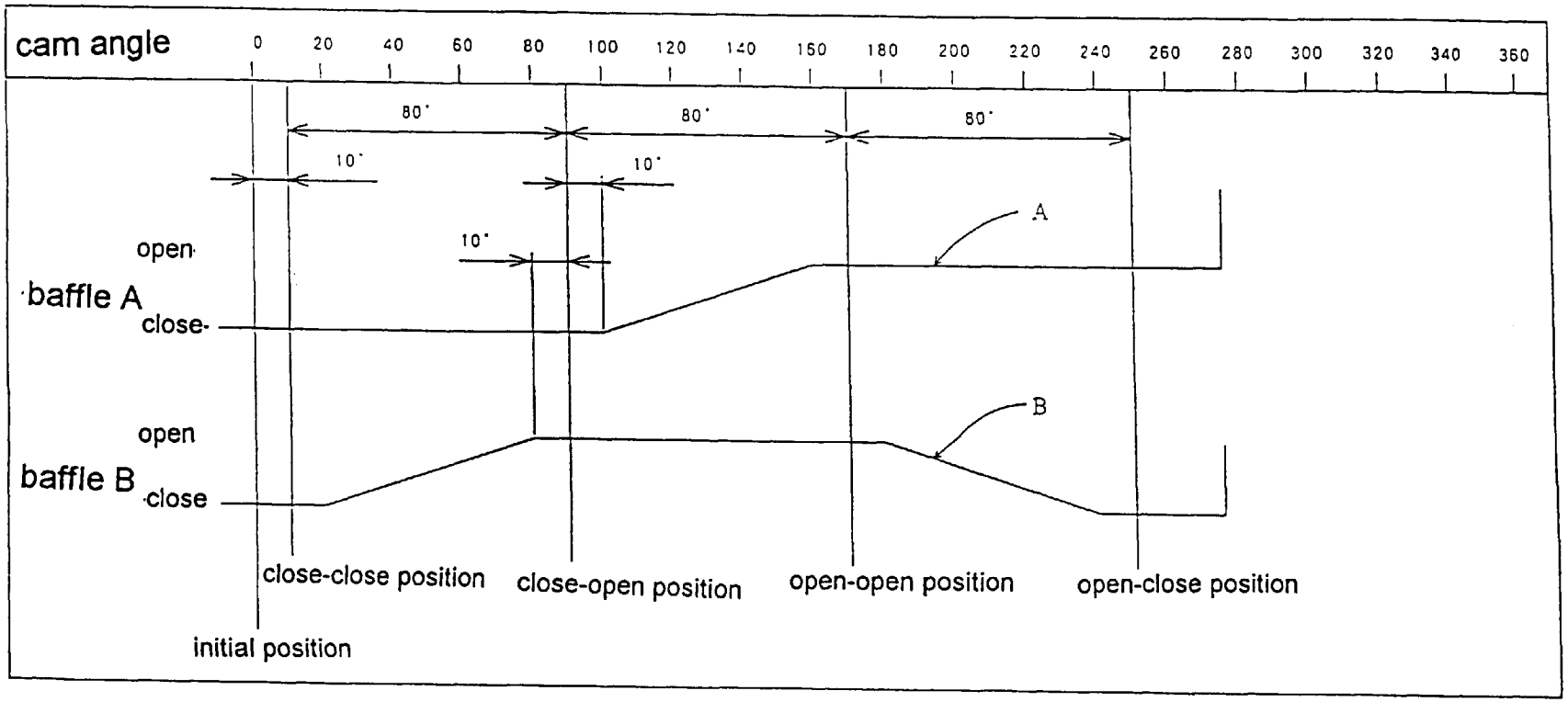
FIG. 14 is a diagram of the cam form formed on the cam in the drive unit in the double damper of FIG. 1.

The relationship between the rotation angle of the cam 10 (hereafter referred to as "cam angle") and the open and close positions of the baffles 5, 5 is described in detail by referring to FIG. 14. The cam form A of the cam groove 10*a* engaged with one baffle 5 (hereafter referred to as baffle A) is indicated with an arrow A in FIG. 14.

The cam form B of the cam groove 10*b* engaged with the other baffle 5 (hereafter referred to as "baffle B) is indicated with an arrow B in FIG. 14. The cam groove 10*a* is, in terms of the groove cam angle, formed within the range of minus several to 275 degrees.

The cam form A is as low as the groove cam at 0 to 100 degrees of the groove cam angle; it becomes gradually higher at about 100 to about 160 degrees; it is as high as the groove cam angle at about 160 degrees to about 275 degrees. Here, the initial position is at 0 degrees as described later, the cam baffle A is in the transition between the open and closed position closed at about 100 to about 160 degrees; the cam baffle A is open at about 160 to about 275 degrees.

The cam groove 10*b* is in the same manner, the groove cam angle is also formed within the range of minus several degrees to about 275 degrees. The cam form B is as low as the groove cam at 0 degrees to 20 degrees; it becomes gradually higher at about 20 to about 80 degrees; it is as high as the groove cam angle at about 80 to about 180 degrees; it becomes gradually lower at about 180 to about 240 degrees; it is as low as the groove cam at about 240 to 275 degrees. Here, the initial position is at 0 degrees as described later, the cam baffle B is closed at about 0 to about 20 degrees; the cam baffle B is in the transition between open and closed position at about 20 to 80 degrees; the baffle B is open at about 80 to about 180 degrees and is closed at about 240 to about 275 degrees.

The initial position is so called "initial" position at which each of the fan-like gears 11*b* touch the case unit 13 and are mechanically locked. This position is used for governing the origin when the positions for the baffles A and B are not clear during assembly or power supply interruption.

In this example, the baffle A and B are driven until they stop at the following groove cam angles:

10;

90;

170; and 250 degrees.

Note that any stop position can be set besides these four positions. That is, the stop positions for the baffles A and B may be set arbitrarily by controlling the number of pulses of the stepping motor 1.

When the cam angle is 0 degrees, the baffle is at the initial position. (See FIG. 15.) At 10 degrees, baffles A and B take the close-close position in which both baffles are closed. (See FIG. 16.) At 170 degrees, both baffles A, B takes the open-open position in which both baffles A and B are open. (See FIG. 18). At 250 degrees, the baffles take the open-closed position in which the baffle A is open and the baffle B is closed.

The arm 11 made of a resin comprises:

an arm unit 11*a;* a fan-like gear unit 11*b;* a pin 11*c;* and other than these, comprises a through hole 11*d* which a pivot 12 formed on the case 13*a* goes through; and a rotation support unit 11*e*.

Between the rotation support units 11*e,* 11*e,* a sleeve 41 is fitted to hold both arms 11,11.

The pivot 12 is formed integral with the case 13*a* which constructs the case unit 13 and is engaged with inside of the cylindrical projection 42 on the base plate 13*b*.

The case 13*a* comprises:

a pivot 12;

fitting hole 34; and support shaft 38. It is formed in a cylindrical shape with a bottom as shown in FIGS. 8 through 10.

Figure 6:
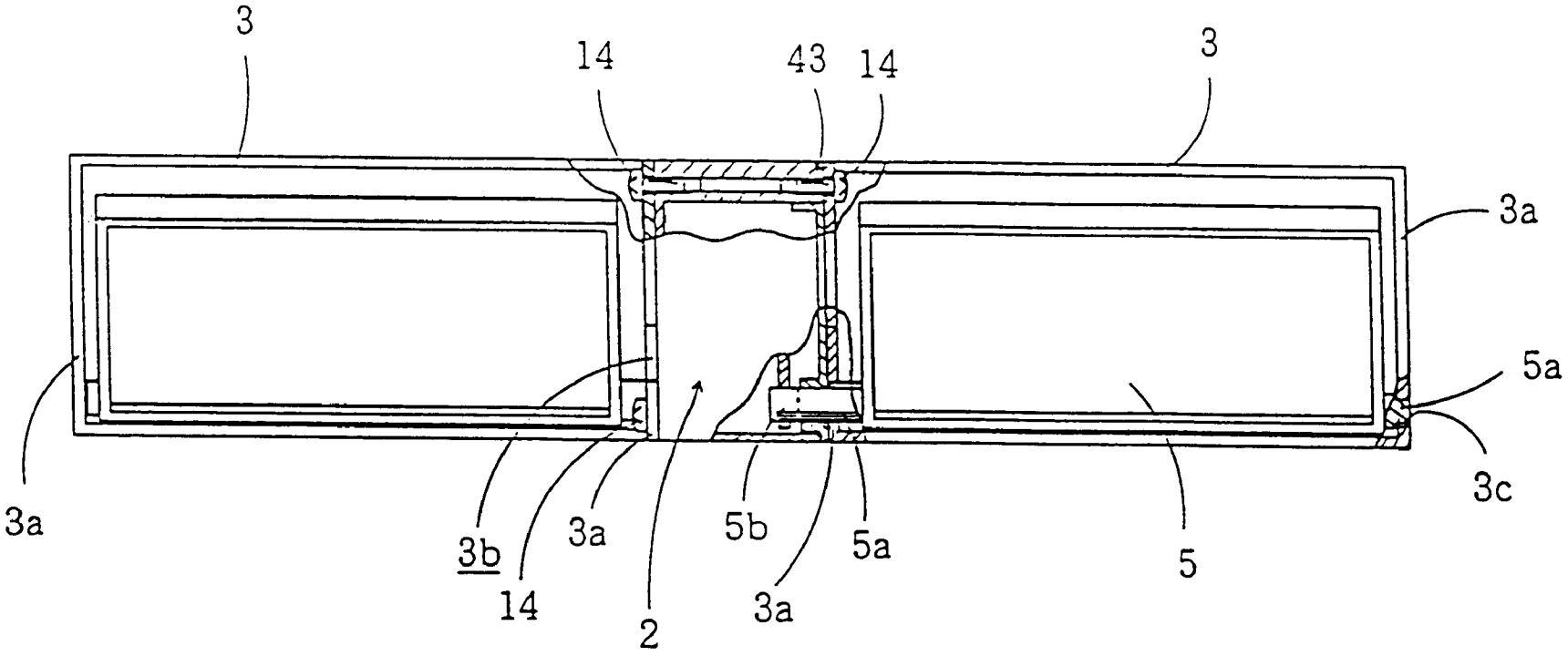
FIG. 6 is a cutaway view of the back of the FIG. 3 viewed from the direction of the arrow VI.

Also, on the case 13*a,* as shown in FIGS. 6 and 7, a cylinder unit 43 is formed at the end of the four corners at the side facing the base plate 13*b;* a screw hole 43*a* is formed to be engaged with the screw 14 in the center of each of the cylindrical units 43. Also, on the case 13*a,* a cylindrical boss 44 which supports one end of the fixed shaft 6 and a pillar 46 located center bottom of the figure are formed. The pillar 46 has a screw hole 46*a* to form it integral with the base plate 13*b* with a screw 45. On the other hand, the base plate 13*b* is formed in a flat plate shape and has the fitting hole 36. Through holes 51 are formed at four corners of the pillar 46 such that the cylindrical unit 43 of the case 13*a* is fitted into them.

Figure 20:
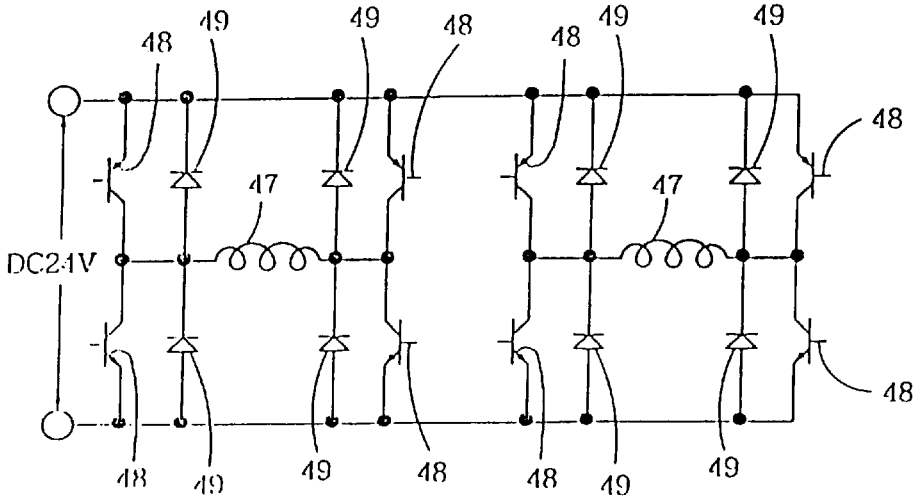
FIGS. 20 is a drive circuit diagram of the double damper of FIG. 1.

The circuit configuration of the stepping motor 1 is shown in FIG. 20. In other words, the circuit comprises:

two coils 47;

eight transistors 48; and eight diodes 49.

Each of the devices is constructed symmetrically to suit bipolar driving.

When transmitting the rotation of the stepping motor 1 to the cam 10, the speed of the stepping motor 1 is reduced to 1/120 of that of the cam 10 via the gear train.

On the other hand, when transmitting the rotation of the fan-like gear unit 11*b* of the arm 11 engaged with the cam 10, the speed of the fan-like gear is increased to five times of that of the gear train.

Note that the detent torque of the stepping motor 1 is small. The reason for this is described herein: the cam grooves 10*a,* 10*b* will mechanically lock the movement of each of the arms 11, 11, therefore, the baffles can maintain their closed or open positions excellently with a small detent torque.

Figure 21A:
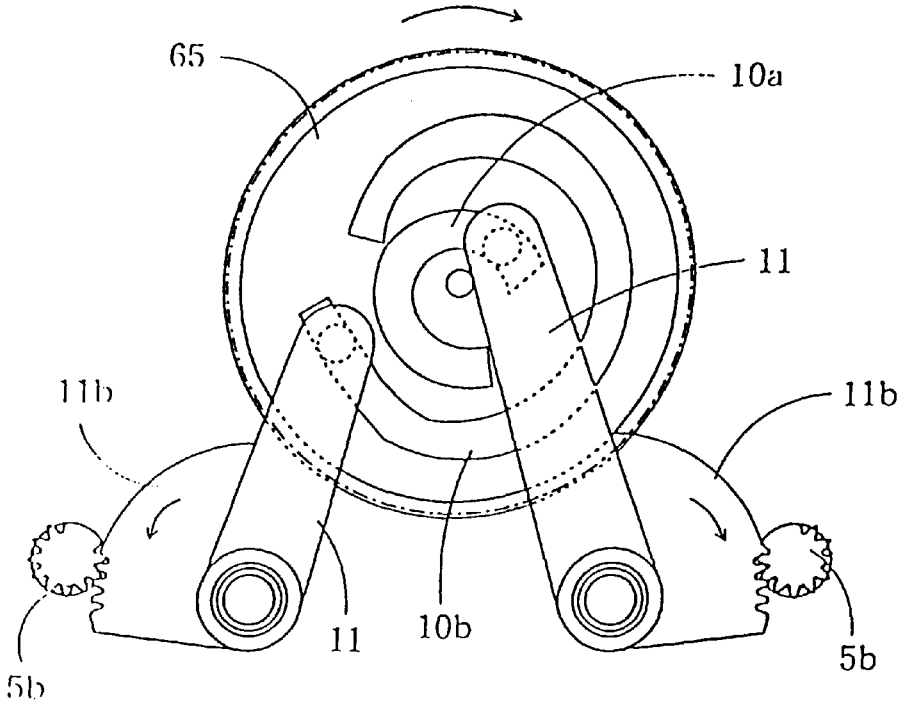
FIGS. 21(A) and 21(B) is a diagram showing the double damper built into a refrigerator.
Figure 21B:
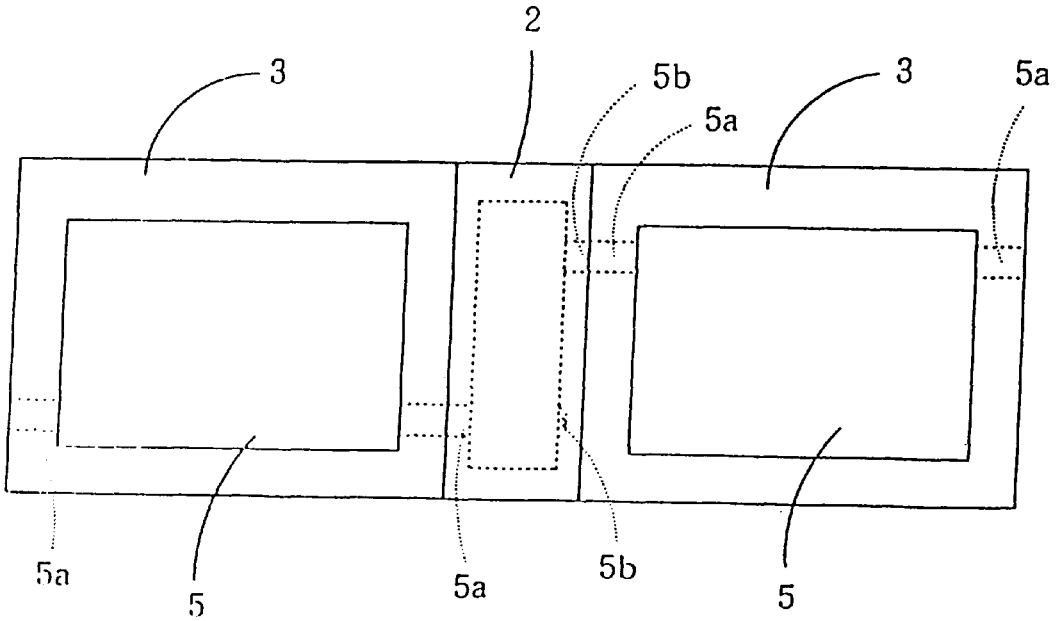
Figure 25:
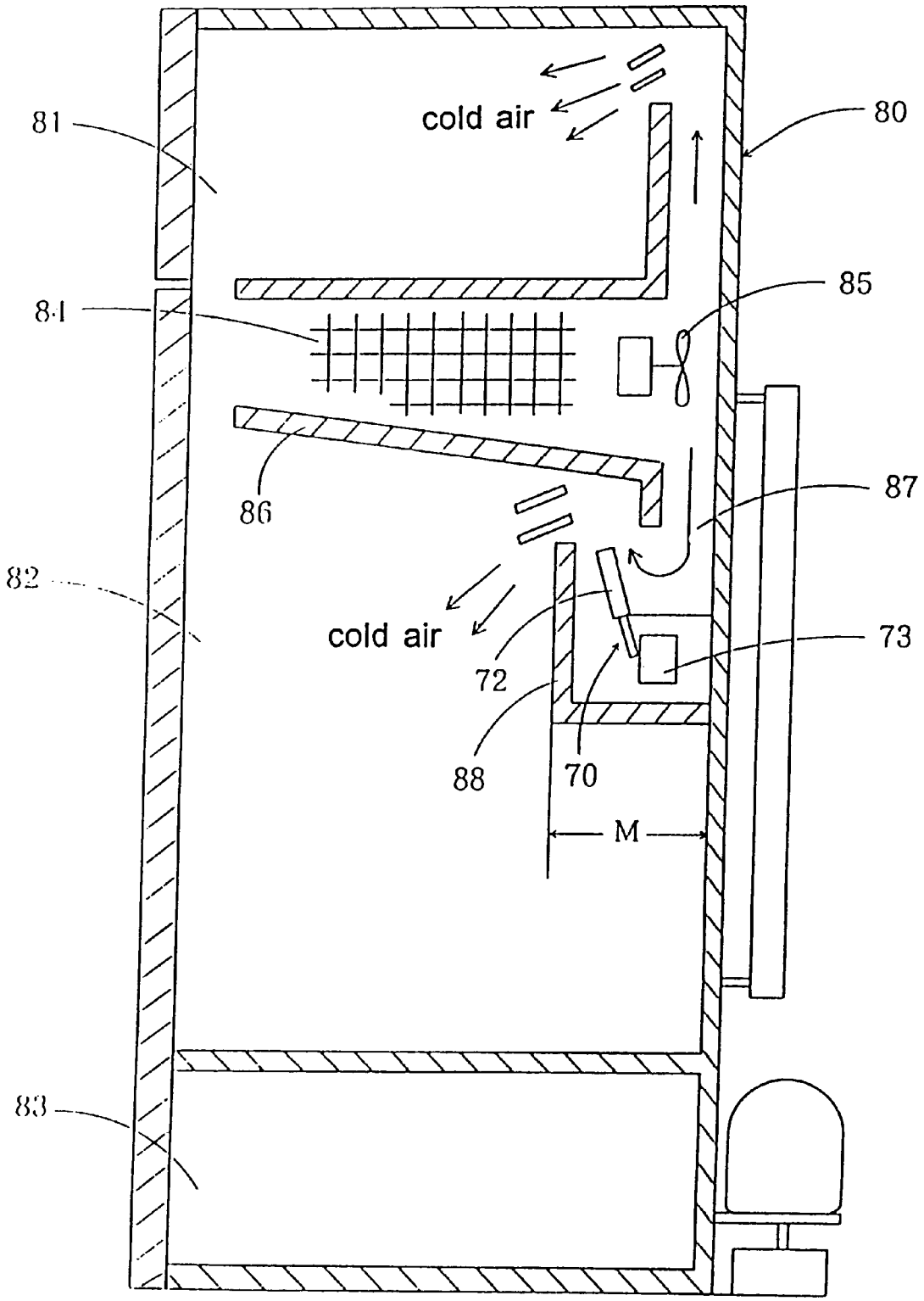
F I G. 25 PRIOR ART
FIG. 25 is a descriptive diagram showing the status in which a motor damper or a double damper is built into a refrigerator of conventional technology.
Figure 26:
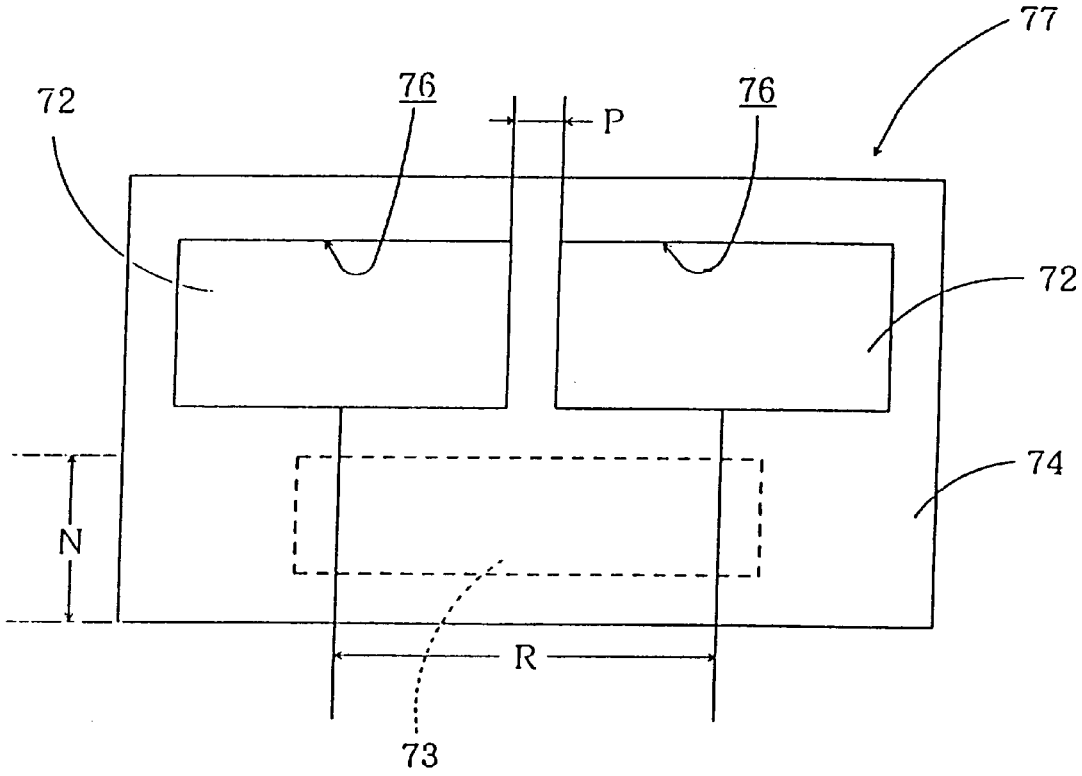
F I G. 26 PRIOR ART
FIG. 26 is a front view of a double damper of conventional technology.

The double damper is built into a refrigerator and the like which has a "mid freezer", for example, shown in FIGS. 21A and 21B. Here, the identical members shown in FIG. 25 are coded the same and not described.

The refrigerator 60 comprises:

a freezer chamber 81 in center;

a refrigerator chamber 82 on top; and a vegetable crisp 83 at the bottom.

Ducts 61 are formed to spread cold air to the refrigerator 82 and to the vegetable crisp 83 through a cold air passages 87.

The double damper is fitted to the duct 61 midway in the cold air passage. The cold air passage 87 on the side which communicates with the freezer chamber 81, the refrigeration chamber 82, vegetable crisp 83 through the inlet 4 is branched into independent cold air passages 87 which communicate with each of the chambers split by the partitions made of an insulation material etc. to control spreading of the cold air into each given chambers. The refrigerator 60 shown in FIGS. 21A and 21B, comprises:

an upper double damper 60A which controls spreading of cold air in the upper and lower refrigeration chambers 82 as illustrated; and a lower double damper 60B which controls spreading of cold air in the freezer chamber 81 and the vegetable crisp 83.

In other words, in the front and back of the refrigerator 60 shown in FIGS. 21A and 21B, separate cold air passages 87 are formed to communicate with separate sections or chambers. Note that the frame 3 of the double damper 60A, 60B is fitted therein to form a part of the duct 61. Also, the locations for the double dampers 60A and 60B may be close to or isolated from the exit of the chamber of the evaporator 84 according to the designing to the refrigerator.

Next, the double damper operation is described. Note that once the double damper is built into the refrigerator 60, the damper is initialized, maintaining the baffles A and B at the close-close position (see FIGS. 16A and 16B). In other word, the double damper is maintained at 10 degrees n terms of the groove cam angle.

At this time, as shown in FIG. 14, at 0 degrees (the initial position) to about 20 degrees of the groove cam position including the close-close position, both cam forms A and B are at the same height; that is the radius for the cam grooves 10*a,* 10*b* remains the same.

For this reason, at 0 degrees, at which the cam is initialized at 0 degrees to about 100 degrees, both baffles A and B are in the initial position.

Also, the radius of the cam groove 10*a* is identical at 0 to 100 degrees; the cam groove 10*a* is identical at 0 to about 20 degrees; therefore, the baffles A and B are together maintained mechanically at the closed position.

The CPU etc. sends commands to control temperatures in the refrigerator by ordering introduction of cold air to the chamber which the baffle B is involved in. The rotor of the stepping motor 1 is driven to transmits the rotation to the baffles A and B via:

the pinion 7*a;* the first gear 8;

the second gear 9;

the cam 10;

arms 11, 11;

gears 5*a,* 5*b;* and drive shafts 5*a,* 5*a.*

As a result, the baffle B driven by the cam groove 10*b* leaves from the cold air inlet 4 and moves to the position parallel to the frame 3.

Figure 17A:
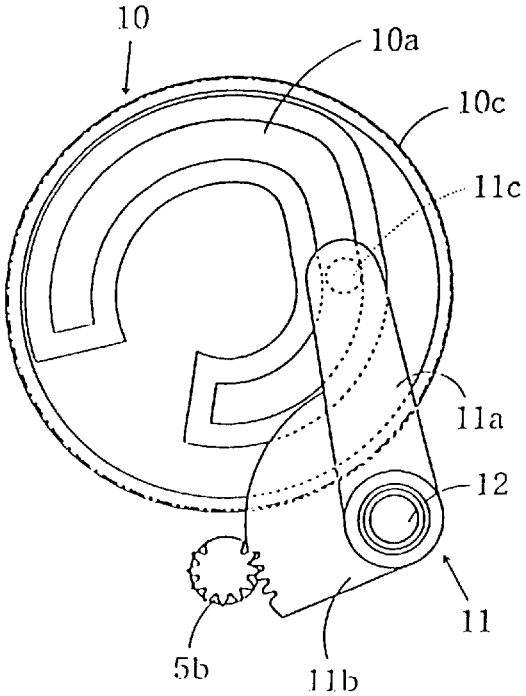
FIGS. 17(A) and FIG. 17(B) show the relationship between the cam and arm when the cam is at 90 degrees of the groove cam angle.
Figure 17B:
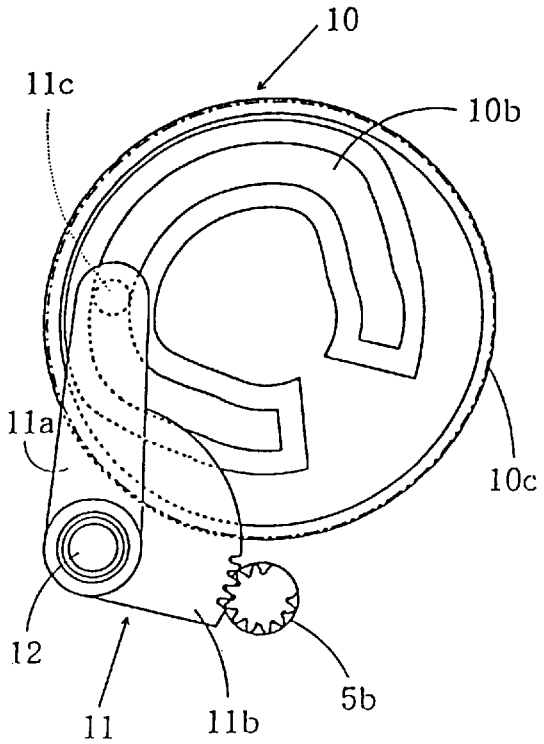

In other words, starting from the 10 degrees of the groove cam angle, if the step number of the stepping motor 1 reaches to a given number, 1280 in this embodiment, the cam 10 turns 80 degrees, the groove cam angle reaches 90 degrees while the baffle B turns 45 degrees at which it opens. On the other hand, the baffle A maintains its closed position. At this close-open position, the arm 11 at the cam groove 10*a* side is locked at the closed position as shown in FIG. 17(A); the arm 11 on the cam groove 10*b* side is also locked at the open position as shown in FIG. 17(B). In addition to this mechanical locking, with the capability to maintain the electrical conduction or detent torque of the stepping motor 1, the baffles A and B maintain their closed and open position.

Figure 18A:
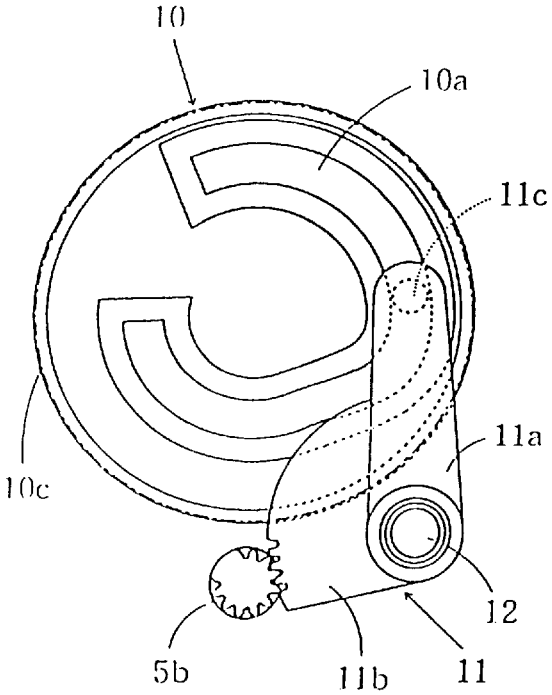
FIGS. 18(A) and FIG. 18(B) show the relationship between the cam and arm when the cam is at 170 degrees of the groove cam angle.
Figure 18B:
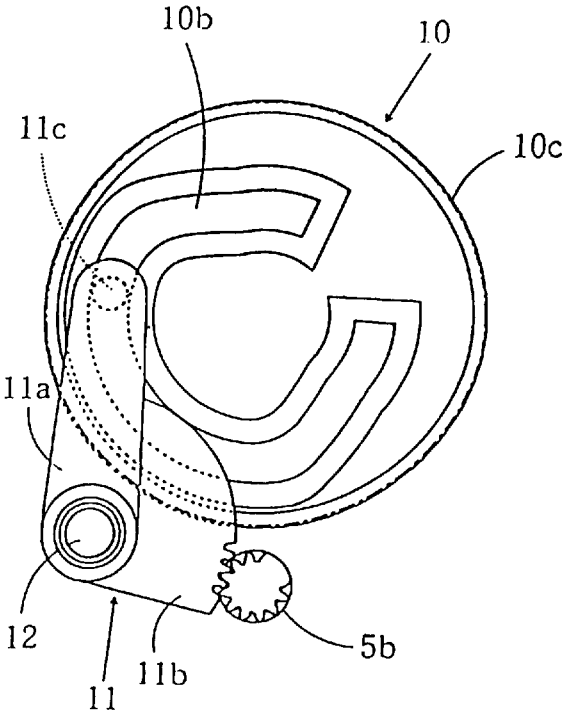
Figure 19A:
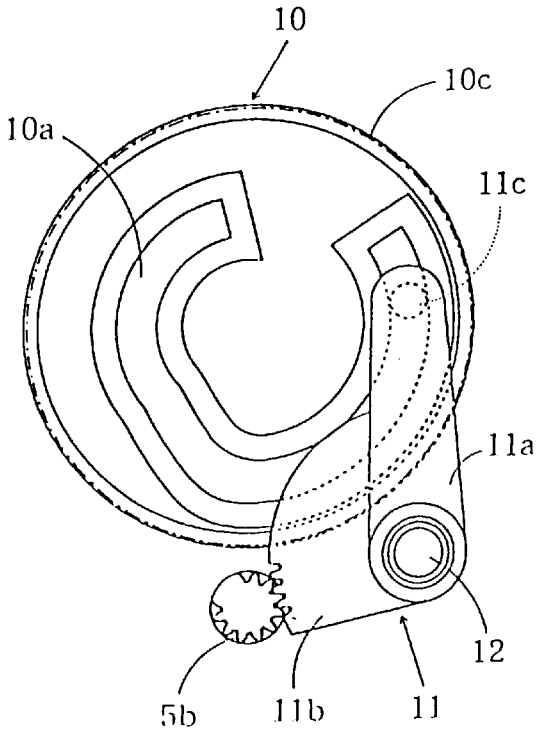
FIGS. 19(A) and FIG. 19(B) show the relationship between the cam and arm when the cam is at 250 degrees of the groove cam angle.
Figure 19B:
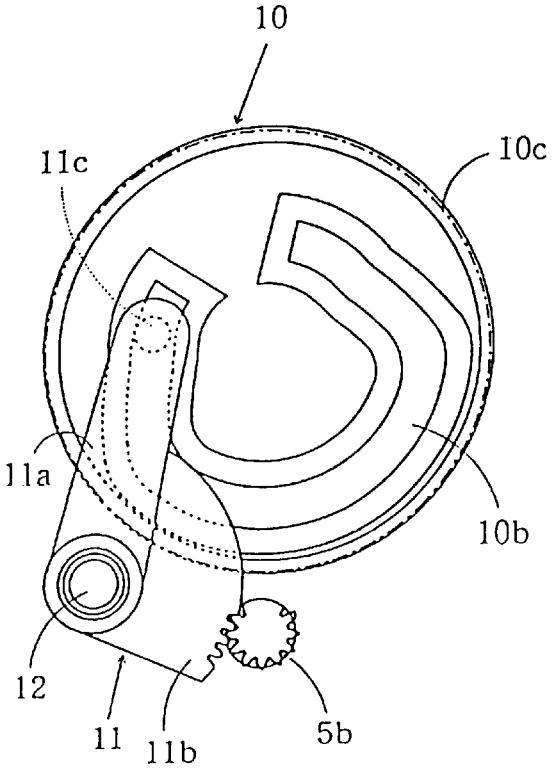

When the CPU etc. in the refrigerator 60 commands introduction of cold air into the chambers which both baffles A and B are involved in at the close-close state of the baffles A and B, the stepping motor 1 drives the cam 10 to turn 10 to 170 degrees of the groove cam angle, the arm 11 on the cam groove 10*a* side takes the status shown in FIG. 18(A) via FIGS. 16(A) through 17(A) and the baffle A opens. On the other hand, the arm 11 of the cam groove 10*b* side takes the status shown in FIG. 18(B) via FIGS. 16(B) through 17(B) and the baffle B also opens. At this time also, both arms 11, 11 are locked and maintain the open position mechanically.

When the CPU etc. in the refrigerator 60 commands introduction of cold air into the chambers which the baffles A is involved in at the close-close state of the baffles A and B, the stepping motor 1 drives the cam 10 to turn it 10 to 250 degrees at which the baffle A opens; the baffle B opens once, then, closes to stop. Then the baffle A is open and the baffle B is closed, which is the open-closed position. At this time also, the arms 11, 11 are locked by the cam grooves 10*a,* 10*b* to hold each of the open and close positions.

Note that the stepping motor 1 continues driving after the soft tape 28 contacts the projection unit 4*c* of the cold air inlet 4 before it stops. That is, the baffle B contacts the projection unit 4*c* at about 235 degrees of the groove cam angle; the cam 10 moves about 5 degrees after the contact; the baffle B further rotates until the projection unit 4*c* abuts the soft tape 28 as shown in FIG. 2. After that, the stepping motor 1 still continues to rotate; the cam 10 also rotates; however, the abutted state does not change because the pin 11*c* and the cam form B move at the same height. For this reason, the perfect contact position as shown in FIG. 2 can be maintained accurately. The stepping motor 1 stops at 250 degrees.

The same sequences are taken when the cam 10 is reverse rotated when the baffle B is open and closes at 10 degrees of the groove cam angle. That is, the soft tape 28 contacts the projection unit 4*c* at about 25 degrees; then, the cam 10 moves about 5 degrees until it abuts the soft tape 289 as shown in FIG. 2. Then, at 10 degrees of the groove cam angle, the stepping motor 1 stops. On the other hand, the baffle A operates in the same manner. In other words, when it moves from the open position to the closed position, the projection unit 4*c* contacts the soft tape 28 at about 105 degrees of the groove cam angle. At the point returned by about 5 degrees (about 100 degrees), it takes the position shown in FIG. 2. After this, even if the cam 10 is further reverse rotated, it maintains the status shown in FIG. 2 when the baffles A and B take the close-open position at 90 degrees, the stepping motor stops. Note that when the baffles A, B return to the close-close position, the stepping motor 1 stops at 10 degrees.

In this way, even after the baffles A and B contact the projection unit 4*c,* the stepping motor 1 drives the cam 10 to further rotate the baffles A and B. Therefore, the torque of the stepping motor 1 is transmitted to the baffles A and B to press the projection unit 4*c* which abuts the resilient soft tape 28 to provide a perfect seal there.

Note that the sealing may be imperfect if the amount of projection of the projection unit 4*c* of the cold air inlet 4 or shapes of the baffles A and B are not uniform; or there is a backlash in the fan-like gear unit 11*b* etc. However, in the double damper, the stepping motor 1 is driven even after the projection unit 4*c* contacts the soft tape 28 to rotate the baffles A and B to have the projection unit 4*c* abut the soft tape 28; this provides a perfect sealing even if there is some variations or backlash as mentioned above.

Now, the baffles A and B can move freely within the four positions such as the open-closed position to the close-open position or the open-close position to another position by controlling the detected step number and rotational direction.

Note that if the pin 11*c* moves to both ends of the cam grooves 10*a,* 10*b,* the baffles A and B abut the projection unit 4*c;* even if the cam 10 reaches at 10 or 250 degrees of the groove cam angle, power may be continually supplied to the stepping motor 1. In this case, the arm 11 must abut the case unit 13 etc. to stop the stepping motor 1 with loss of synchronism. In this way, the microcomputer etc. in the refrigerator 60 can detect the loss of synchronism and use it as its origin.

In other words, the close or open position is used as the origin of the baffle movement. Note that in this embodiment, the baffle position is not initialized during normal operation; it is initialized during assembly or during start up when power supply is interrupted using the loss of synchronism as a means to confirm the origin, 0 degrees of the groove cam angle.

In addition, if power supply to the stepping motor 1 is interrupted when the projection unit 4*c* is abutted to the soft tape 28, the rebound from the soft tape 28 is transmitted to the gear 5*b* or the fan-like gear unit 11*b* via the drive shaft 5*a.* However, the pin 11*c* is firmly locked by the cam grooves 10*a,* 10*b,* therefore, the cam 10 does not rotate. The backlash is eliminated In this way at the gear 5*b* and the fan-like gear 11*b.* Also, even if the cam 10 is moved, the detent torque generated by the stepping motor 1 prevents the rotor 7 from unwanted rotation. Therefore, if the cam 10 is moved, the backlash does not occur at the first gear 8, the second gear 9, etc., thus favorably eliminating inaccuracy in the transmission mechanism which covers from the rotor 7 of the stepping motor 1 to the baffles A and B. Note that the backlash at the gear 5*b* etc. of this embodiment, is about 0.05 mm; this is very small. Eliminating backlash prevents unfavorable vibration in the mechanism.

The time required for changing positions for the baffles A and B from the open position to the closed position or vise versa is controlled by the pulse generation rate. In this embodiment, it is 400 pps (pulse per second) at which the cam 10 rotates 80 degrees of the groove cam angle in about 3 seconds. However, other pulse rates may be arbitrarily selected. Also, the baffles A and B may be stopped in the middle of the open and closed position rather than the perfectly open position. In other words, in FIG. 14, in addition to the positions at 10, 90, 170, and 250 degrees, 50, 130, and 210 degrees may be used. Note that the movement angle from the open to closed positions is 45 degrees in this embodiment, however, other angles may be arbitrarily selected.

In this embodiment, the drive unit 2 is formed between the two cold air inlets 4, 4 to reduce the dead space thereon. Also, the drive unit 2 is arranged to increase the distance between the two cold air inlets 4, 4; this effectively increases the heat insulation capability thus making it possible to control temperature accurately. In addition, the drive unit 2 is located between the cold air inlets 4, 4; this makes it easy to transmit the force to each of the baffles A and B and provides a wider variety for the distances between the cold air inlets 4, 4 than conventional technology. In this way, the mechanism of the drive unit 2 can be simplified; the structure suited to heat insulation can be designed easily with a good control of the cold air flow. The cold air inlet 4 is formed perpendicular to the frame 3, thus, the frame 3 can be made thinner. The entire size of the apparatus can be smaller; this makes it easier to install the double damper to any different equipment such as a refrigerator.

Also in this embodiment, the open position of the baffles A and B is almost parallel to the frames 3, 3; when they are at the open position, cold air which flows in along the frames 3, 3 will not be hindered by the baffles A and B or the cold air inlets 4, 4; the air flows linearly. This eliminates loss of cold air during transmission; this provides a refrigerator of excellent transmission and diffusion of cold air. In addition, the rotation of the arm 11 is increased when the force is transmitted to the gear 5*b*, a small movement of the cam grooves 10*a*, 10*b* can be transmitted to the gear 5*b*, and at the same time, the rotation angle of the baffle 5, 5 is increased. Moreover, the arm 11 is abutted to the case unit 13 etc. to prevent the stepping motor 1 from running out of control; this provides a double damper which is credible. In addition, the stepping motor 1, which is used as the driving source, is capable of reversed rotation; this makes it possible to control baffles accurately.

The embodiment is the preferable mode of the present invention. However, the present invention is not limited to this. A variety of modifications can be made within the spirit of the present invention. For example, a single frame 3 and a single baffle 5 may be used to construct a damper. Two stepping motors 1 may be used for driving the baffle 5 rather than one stepping motor 1. Another type of motors such as a synchronous motor may be used as another driving source rather than a stepping motor. Note that if a DC motor etc. is used, detecting the positions of the baffles 5, 5 may require some development, in which, for example, a magnet is fixed on the cam 10 to detect the position of the magnet by a hole device etc. or by controlling the time during which a DC motor etc. is driven.

The soft tape 28 is used in this embodiment, however, when a perfect sealing is not required, the soft tape 28 may be omitted. Also, regardless of whether or not the soft tape 28 is attached, the stepping motor 1 may be stopped immediately when the cold air inlets 4, 4 and the baffles 5, 5 contact. In this way, in the close position in which no cold air should leak, the cold air inlet 4 can be isolated by the baffle 5 even more accurately.

Also in this embodiment, a reduced rotation gear train is used, but the reduced rotation gear train is not always required.

In addition, the bipolar driving method is used for driving the stepping motor 1 but unipolar driving method, etc. may be used if required; different specifications may be used for different step angles or torques etc. for different uses. The pin 11*c* of the arm 11 may be split; the guide unit at the cam 10 side may be made as a projection which enters the split pin 11*c* to regulate the position of the arm 11.

Figure 22:
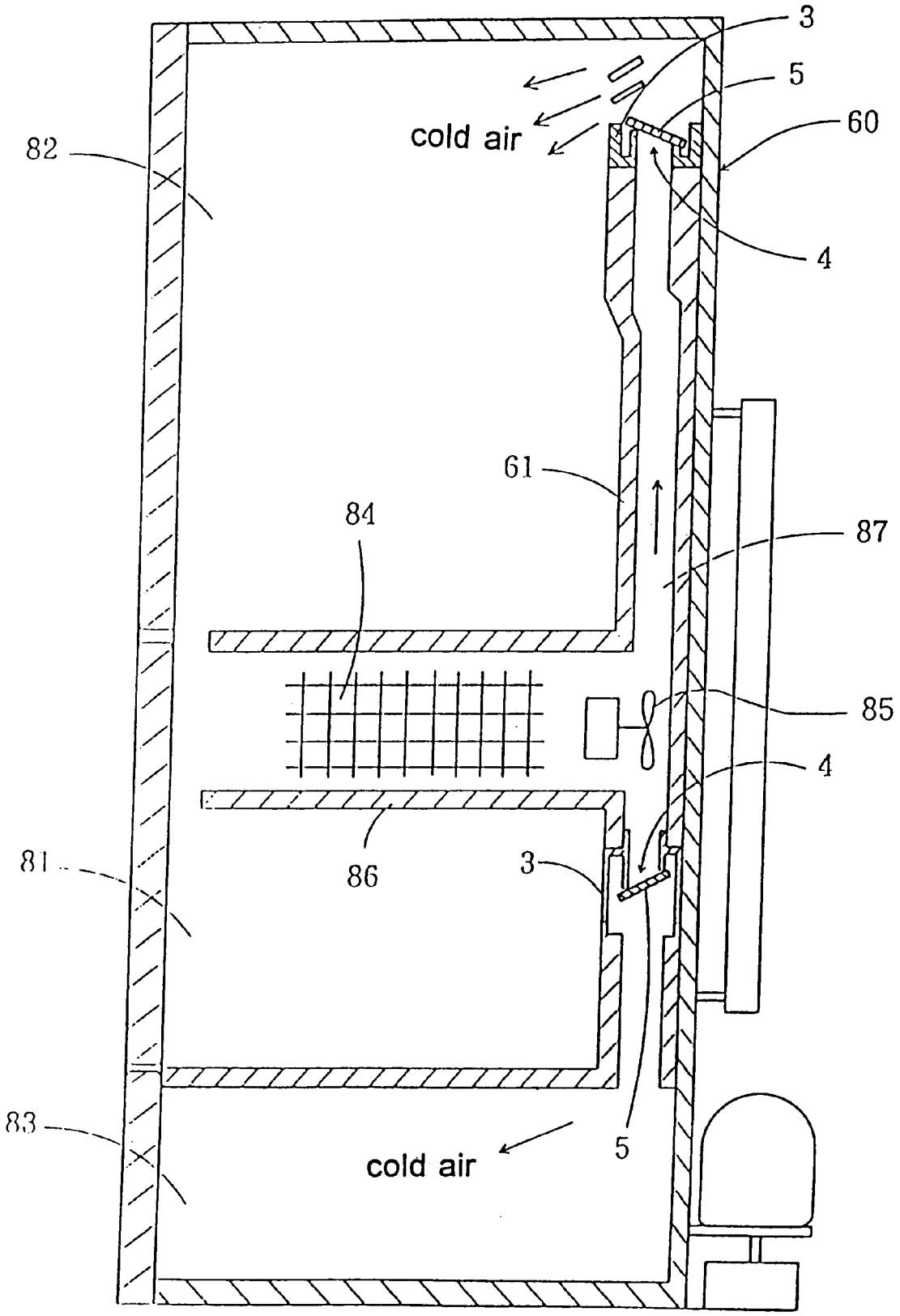
FIG. 22 is a diagram showing a modification example 1 of the double damper of FIG. 1.
Figure 23A:
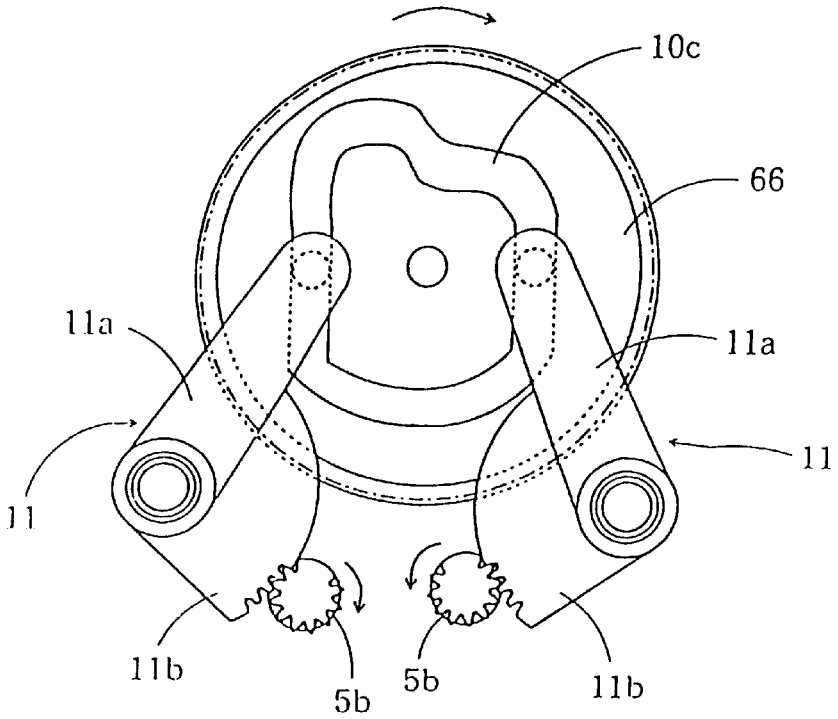
FIGS. 23(A) and 23(B) is a diagram showing a modification example 2 of the double damper of FIG. 1.
Figure 23B:
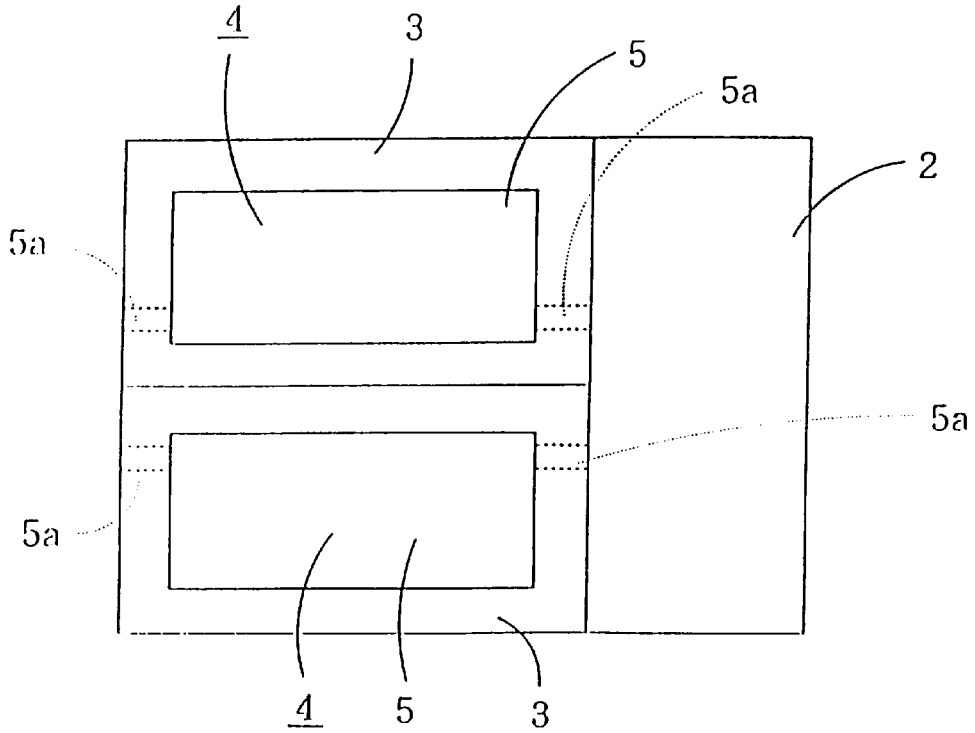
Figure 24:
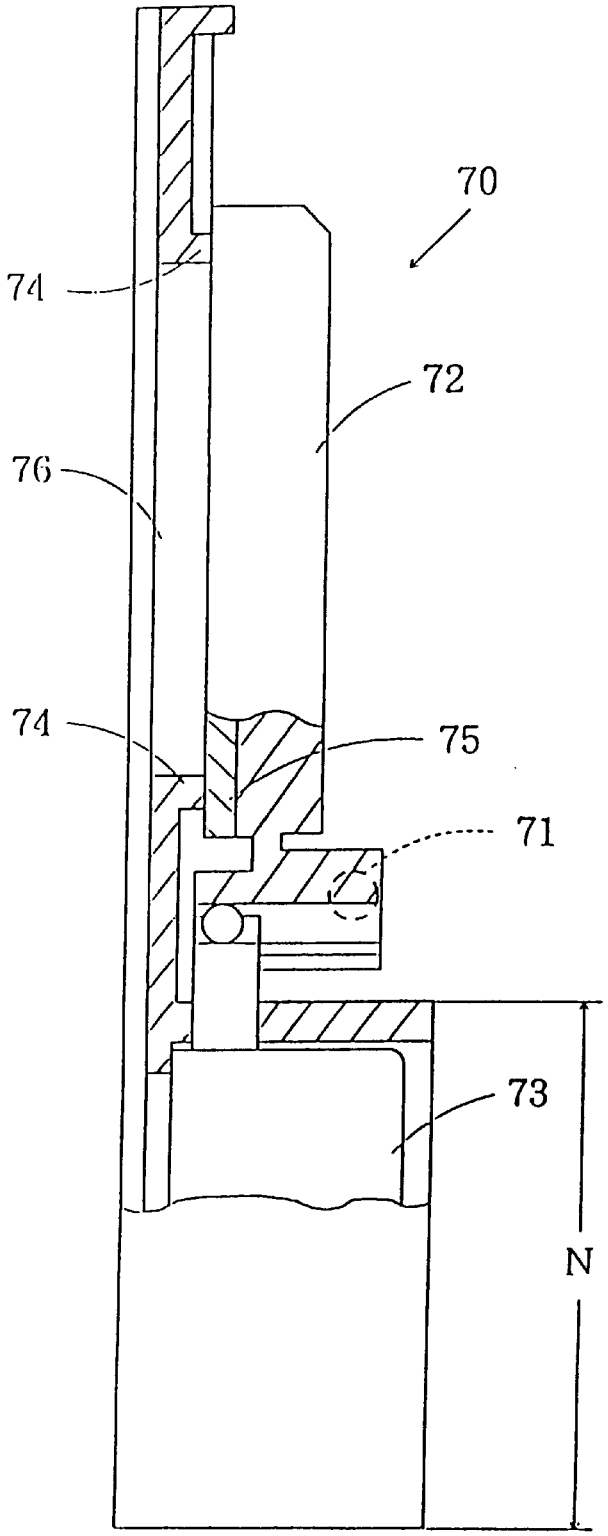
F I G. 24 PRIOR ART
FIG. 24 is a partial cross side section of the motor damper of conventional technology.

Note that in the damper of the present invention, the frames 3, 3 are formed like ducts, but the present invention can be used for a damper of any other configurations. It can also be used not only for refrigerators but also for a variety of dampers such as ducts used for controlling ventilation of other fluids. Also, the frames 3, 3 may be formed on the frame which is at the side at which the damper is installed, for example, taking advantage of the duct 61 which controls the cold air flow in the refrigerator 60 as shown in FIG. 22. When three or more cold air inlets 4 are formed, the damper can be used as a part of them.

As described, the double damper of the present invention can have a large opening angle for gate plates using the cam and link mechanism and can decrease the size of the drive unit. In addition, the gate plates are driven via the cam and link mechanism, the position of the gate plates can be maintained mechanically; this stabilizes the open/close movement and the cold air inlets can be sealed by the baffle accurately. Also, a drive unit is formed between the two cold air inlets and the dead space can be reduced. Moreover, the drive unit is arranged to increase the distance between two cold air inlets; this increases heat sealing effect and provides the capability to control temperatures accurately.

In addition, the drive unit exists between the cold air inlets; this makes it easier than conventional technology to transmit the force to each of the gate plates and provides the capability for setting different distances between the cold air inlets. Therefore, the drive unit mechanism can be simplified and designing which suits heat sealing and air flow can be made easier.

While the foregoing description and drawings represent the preferred embodiments of the present invention, it will be obvious to those skilled in the art that various changes and modifications may be made therein without departing from the true spirit and scope of the present invention.

What is claimed is:

1. In a refrigerator, a damper comprising:

two cold air inlets through which a fluid flows;

two gate plates which open and close said two cold air inlets; and a drive unit for driving said two gate plates being installed between said two cold air inlets to open and close said gate plates, said drive unit operating to control said fluid flow;

wherein a drive shaft is formed on each of said two gate plates;

side walls which support each of said drive shafts are formed on the frame on which said cold air inlets are formed; and said drive unit is formed between two adjacent side walls in the center of said side walls.

2. A damper comprising:

two cold air inlets through which a fluid flows;

two gate plates which open and close said two cold air inlets;

a drive unit for driving said two gate plates being installed between said two cold air inlets to open and close said gate plates, said drive unit operating to control said fluid flow;

a drive source;

a cam which is driven by said drive source and has a guide unit for opening and closing said gate plates;

a pin whose movement is guided by said engaged guide unit which regulates the position of said pin; and an arm on which an engagement unit which is engaged with said drive shaft of said gate plates is formed;

wherein said arm transmits the force generated by said cam driven by said drive source to said pin which moves along said guide unit;

said drive shaft is driven via said engagement unit according to the moving amount of said pin to open and close said gate plates.

3. A damper comprising:

two cold air inlets through which a fluid flows;

two gate plates which open and close said two cold air inlets;

a drive unit for driving said two gate plates being installed between said two cold air inlets to open and close said gate plates, said drive unit operating to control said fluid flow;

a motor which is the driving source;

a reduced rotation gear train which is engaged with the output shaft of said motor;

a cam which is driven by said reduced rotation gear train and has cam grooves on both surfaces which work as a guide unit; and two arms which transmit the force to said drive shaft formed on said gate plates.

4. A damper according to claim 1 wherein said drive shaft formed on said gate plates is driven by the driving source.

5. A damper for a refrigerator, comprising:

two cold air inlets formed on the hollow side of two cold air passages through which cold air flows in;

two gate plates which open and close said two cold air inlets for the refrigerator;

a drive unit which drives said two gate plates being formed between said two cold air inlets;

said gate plates are opened and closed by said drive unit to control incoming said cold air;

a drive shaft formed on each of said two gate plates;

side walls which support each of said drive shafts formed on the frame on which said cold air inlets are formed; said drive unit being formed between two adjacent side walls in the center of said side walls.

6. A damper for a refrigerator according to claim 5 wherein said drive unit is formed between two cold air passages.

7. A damper for a refrigerator, comprising:

two cold air inlets formed on the hollow side of two cold air passages through which cold air flows in;

two gate plates which open and close said two cold air inlets for a refrigerator;

a drive unit for driving said two gate plates being formed between said two cold air inlets;

said gate plates being opened and closed by said drive unit to control incoming said cold air;

a drive source;

a cam which is driven by said drive source and has a guide unit for opening and closing of said gate plates;

a pin whose movement is guided by said engaged guide unit which regulates the position of said pin; and an arm on which an engagement unit which is engaged with said drive shaft of said gate plates is formed;

wherein said arm transmits the force generated by said cam driven by said drive source to said pin which moves along said guide unit and said drive shaft is driven via said engagement unit according to the moving amount of said pin to open and close said gate plates.

8. A damper for a refrigerator according to claim 7 in which the open position of said gate plates is the position at which said cold air inlet is completely open.

9. A damper for a refrigerator, comprising:

two cold air inlets formed on the hollow side of two cold air passages through which cold air flows in;

two gate plates which open and close said two cold air inlets for a refrigerator;

a drive unit which drives said two gate plates being formed between said two cold air inlets;

said gate plates are opened and closed by said drive unit to control incoming said cold air;

wherein said drive unit comprises:

a motor which is the driving source;

a reduced rotation gear train which is engaged with the output shaft of said motor;

a cam which is driven by said reduced rotation gear train and has a guide unit made of cam grooves on both surfaces which work as a guide unit; and two arms which transmit the force to said drive shaft formed on said gate plates.

10. A damper for a refrigerator according to claim 5 wherein said drive shaft formed on said gate plates is directly driven by said drive source.

11. A damper according to claim 1, wherein said drive unit comprises:

a motor which is the driving source;

a reduced rotation gear train which is engaged with the output shaft of said motor;

control means driven by said drive source through said reduced rotation gear train controlling independently an opening and closing of said two gate plates.

12. A damper for a refrigerator according to claim 5, wherein said drive unit comprises:

a motor which is the driving source;

a reduced rotation gear train which is engaged with the output shaft of said motor;

control means driven by said drive source through said reduced rotation gear train for controlling independently an opening and closing of said two gate plates.

* * * * *